US009066398B2

(12) United States Patent
Zhang

(10) Patent No.: US 9,066,398 B2
(45) Date of Patent: Jun. 23, 2015

(54) METHOD FOR REDUCING STANDBY POWER CONSUMPTION

(71) Applicant: Shenzhen China Star Optoelectronics Technology Co., Ltd., Shenzhen, Guangdong Province (CN)

(72) Inventor: Xianming Zhang, Shenzhen (CN)

(73) Assignee: Shenzhen China Star Optoelectronics Technology Co., Ltd., Shenzhen, Guangdong Province (CN)

( * ) Notice: Subject to any disclaimer, the term of this patent is extended or adjusted under 35 U.S.C. 154(b) by 362 days.

(21) Appl. No.: 13/806,775

(22) PCT Filed: Nov. 25, 2012

(86) PCT No.: PCT/CN2012/085225

§ 371 (c)(1),
(2) Date: Dec. 22, 2012

(87) PCT Pub. No.: WO2014/075337

PCT Pub. Date: May 22, 2014

(65) Prior Publication Data

US 2014/0132160 A1 May 15, 2014

(51) Int. Cl.

| | |
|---|---|
| ***H05B 37/00*** | (2006.01) |
| ***H05B 39/00*** | (2006.01) |
| ***H05B 37/02*** | (2006.01) |
| ***H05B 33/08*** | (2006.01) |

(52) U.S. Cl.
CPC ..... *H05B 33/0845* (2013.01)

(58) Field of Classification Search
CPC ..... H05B 37/00; H05B 39/00; H05B 37/02; H05B 39/04; H05B 33/0869
USPC ..... 315/160, 172, 176
See application file for complete search history.

(56) References Cited

U.S. PATENT DOCUMENTS

| | | | | |
|---|---|---|---|---|
| 5,955,909 | A | 9/1999 | Lenz et al. | |
| 8,508,157 | B2 * | 8/2013 | Kim et al. | 315/308 |

FOREIGN PATENT DOCUMENTS

| | | | |
|---|---|---|---|
| CN | 201234390 | Y | 5/2009 |
| CN | 102082500 | A | 6/2011 |
| CN | 202487118 | U | 10/2012 |

* cited by examiner

*Primary Examiner* — Hai L Nguyen
(74) *Attorney, Agent, or Firm* — Cheng-Ju Chiang

(57) ABSTRACT

The present invention provides a method for reducing standby power consumption, which includes providing an LED driving chip; connecting an integrator to a brightness control terminal of the driving chip, connecting the integrator to a comparator, connecting the comparator to a field-effect transistor, connecting the field-effect transistor to the driving chip; connecting the driving chip to a first power source, connecting a high voltage switch terminal of the driving chip via a resistor to a second power source, connecting the brightness control terminal and the integrator to a control source, and connecting the integrator to a reference voltage; and conducting the first and second power sources, the control source, and the reference voltage to allow the integrator and the comparator to pull down voltage of the high voltage switch terminal of the driving chip according to the conduction of the field-effect transistor by a signal of the brightness control terminal.

11 Claims, 3 Drawing Sheets

METHOD FOR REDUCING STANDBY POWER CONSUMPTION

BACKGROUND OF THE INVENTION

1. Field of the Invention

The present invention relates to the field of liquid crystal displaying, and in particular to a method for reducing the power consumption of an LED (Light-Emitting Diode) driving chip in a standby condition.

2. The Related Arts

Energy saving is a common consensus of all countries in the world and how to reduce standby power consumption of liquid crystal television is now a technical hot spot of a worldwide industry. In the current scenario of major economic crisis, household electrical appliances that save power consumption are getting more popular to the general consumers. In the sector of complete TV set, certain organizations are now working with the manufactures of the complete TV set to bring into practice energy saving certification.

Standby power consumption is referred to the power consumption taken by basic functions of household electrical appliances in a shutoff condition or not put into operation. Contrary to the effective power consumption that is taken when a household electrical appliance is in operation, the standby power consumption is basically a waste of energy. According to international authorities, the standby power consumption of household electrical appliances of the world takes about 3%-13% of civil power consumption and is about 2% of gross power generation. Of the standby power consumption, audio/video devices, such as television, takes a share of about 68.6%. The standby power consumption of television in China is as high as 8.07 W/set.

To conserve the limited electricity resources, European Industrial Alliance (EACEM) stipulates audio products that enter Europe must have a standby power consumption less than 5 W effective as of Jan. 1, 2001, which was lowered to 3 W as of Jan. 1, 2004, and 1 W as of Jan. 1, 2007. China also stipulates that all television sets having a standby power consumption that is greater than 9 W are prohibited from sales as of Mar. 1, 2006 and the energy saving grade is 1 W. In the state of the art, the backlighting of liquid crystal televisions is often an LED light source. A drive chip of an LED light requires three signals, namely VCC, BLON, and PDIM, as shown in FIG. 1, of which VCC stands for input voltage, BLON is an enable signal, and PDIM is a dimmer signal. During use, VCC voltage is constantly present and during standby condition, PDIM voltage is kept in a low level.

However, the state of the art shows a shortcoming of simply overlooking BLON signal being potentially in a high level in the standby condition. Under this condition, most of the functions of the LED driving chip start to operate. This increases power loss of the LED driving chip, which means an increase of standby power consumption.

Thus, it is an issue to be urgently improved by those devoted themselves to the field to provide a driving circuit and method to effectively reduce standby power consumption of a liquid crystal display in order to reduce consumption of an LED driving chip in a standby condition of the liquid crystal display.

SUMMARY OF THE INVENTION

An object of the present invention is to provide a method for reducing standby power consumption that compulsorily pulls down voltage of high voltage switch terminal of an LED driving chip, effectively reduces the loss of IC of LED driving chip in a standby condition, and thus reduces the standby power consumption.

To achieve the object, the present invention provides a method for reducing standby power consumption, which comprises the following steps:

(1) providing an LED driving chip, wherein the LED driving chip comprises a brightness control terminal, a high voltage switch terminal, a first power terminal, and a first grounding terminal;

(2) providing a comparator, a field-effect transistor, and an integrator, wherein the comparator comprises a non-inverting input terminal, an inverting input terminal, and a first output terminal and the integrator comprises a first input terminal, a second input terminal, and a second output terminal;

(3) electrically connecting the first input terminal of the integrator to the brightness control terminal of the LED driving chip, electrically connecting the second output terminal to the inverting input terminal of the comparator, grounding the non-inverting input terminal, electrically connecting the first output terminal to the field-effect transistor, and electrically connecting the field-effect transistor to the high voltage switch terminal and grounding line of the LED driving chip;

(4) providing a first power source, a second power source, a control source, a resistor, and a reference voltage, wherein the first power terminal of the LED driving chip is electrically connected to the first power source; the first grounding terminal is electrically connected to the grounding line; the high voltage switch terminal of the LED driving chip is electrically connected via the resistor to the second power source; the brightness control terminal and the first input terminal are electrically connected to the control source; and the second input terminal of the integrator is connected to the reference voltage; and (5) conducting on the first power source, the second power source, the control source, and the reference voltage, whereby the integrator and the comparator compulsorily pull down the voltage of the high voltage switch terminal of the LED driving chip according to the conduction of the field-effect transistor controlled by the signal on the brightness control terminal.

Level of the reference voltage is determined according to a calculation made on maximum voltage, minimum voltage, and minimum duty cycle of a control signal supplied from the control source.

When the control signal supplied from the control source is of the minimum duty cycle, the level of the reference voltage makes the output voltage of the integrator exceeding 0V.

The comparator further comprises a second power terminal and a second grounding terminal. The second power terminal and the second grounding terminal are externally connectable to an operational power supply for the comparator.

The comparator has a model number of LM324.

The field-effect transistor comprises a gate terminal, a source terminal, and a drain terminal and in Step (3), the gate terminal is electrically connected to the first output terminal; the source terminal is connected to a grounding line; and the drain terminal is electrically connected to the high voltage switch terminal of the LED driving chip.

The field-effect transistor comprises an N-channel field-effect transistor.

The LED driving chip further comprises a plurality of output terminals, which is respectively connected to LED lights.

The output terminals of the LED driving chip have a number of 6.

The LED driving chip is selectively of a model number of TLC5941, MBI5028, and ST2221C.

The present invention also provides a method for reducing standby power consumption, which comprises the following steps:

(1) providing an LED driving chip, wherein the LED driving chip comprises a brightness control terminal, a high voltage switch terminal, a first power terminal, and a first grounding terminal;

(2) providing a comparator, a field-effect transistor, and an integrator, wherein the comparator comprises a non-inverting input terminal, an inverting input terminal, and a first output terminal and the integrator comprises a first input terminal, a second input terminal, and a second output terminal;

(3) electrically connecting the first input terminal of the integrator to the brightness control terminal of the LED driving chip, electrically connecting the second output terminal to the inverting input terminal of the comparator, grounding the non-inverting input terminal, electrically connecting the first output terminal to the field-effect transistor, and electrically connecting the field-effect transistor to the high voltage switch terminal and grounding line of the LED driving chip;

(4) providing a first power source, a second power source, a control source, a resistor, and a reference voltage, wherein the first power terminal of the LED driving chip is electrically connected to the first power source; the first grounding terminal is electrically connected to the grounding line; the high voltage switch terminal of the LED driving chip is electrically connected via the resistor to the second power source; the brightness control terminal and the first input terminal are electrically connected to the control source; and the second input terminal of the integrator is connected to the reference voltage; and (5) conducting on the first power source, the second power source, the control source, and the reference voltage, whereby the integrator and the comparator compulsorily pull down the voltage of the high voltage switch terminal of the LED driving chip according to the conduction of the field-effect transistor controlled by the signal on the brightness control terminal;

wherein level of the reference voltage is determined according to a calculation made on maximum voltage, minimum voltage, and minimum duty cycle of a control signal supplied from the control source;

wherein when the control signal supplied from the control source is of the minimum duty cycle, the level of the reference voltage makes the output voltage of the integrator exceeding 0V;

wherein the comparator further comprises a second power terminal and a second grounding terminal, the second power terminal and the second grounding terminal being externally connectable to an operational power supply for the comparator;

wherein the comparator has a model number of LM324;

wherein the field-effect transistor comprises a gate terminal, a source terminal, and a drain terminal and in Step (3), the gate terminal is electrically connected to the first output terminal; the source terminal is connected to a grounding line; and the drain terminal is electrically connected to the high voltage switch terminal of the LED driving chip;

wherein the field-effect transistor comprises an N-channel field-effect transistor;

wherein the LED driving chip further comprises a plurality of output terminals, which is respectively connected to LED lights;

wherein the output terminals of the LED driving chip have a number of 6; and wherein the LED driving chip is selectively of a model number of TLC5941, MBI5028, and ST2221C.

The efficacy of the present invention is that the present invention provides a method for reducing standby power consumption, which comprise a comparator and an integrator to sample a signal on the brightness control terminal of IC of the LED driving chip so as to supply, at the time when a liquid crystal panel is in a standby condition, a control voltage to conduct a field-effect transistor connected to the high voltage switch terminal of the LED driving chip thereby compulsorily pulling down the voltage on the high voltage switch terminal to achieve the purpose of shutting off mot of the functions of the LED driving chip and thus effectively reducing the loss of the LED driving chip in the standby condition and reducing the standby power consumption. This method can be easily carried out.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, of the present invention will be apparent from the following detailed description of an embodiment of the present invention, with reference to the attached drawings. In the drawings.

DETAILED DESCRIPTION OF THE PREFERRED EMBODIMENTS

To further expound the technical solution adopted in the present invention and the advantages thereof, a detailed description is given to a preferred embodiment of the present invention and the attached drawings.

Figure 1:
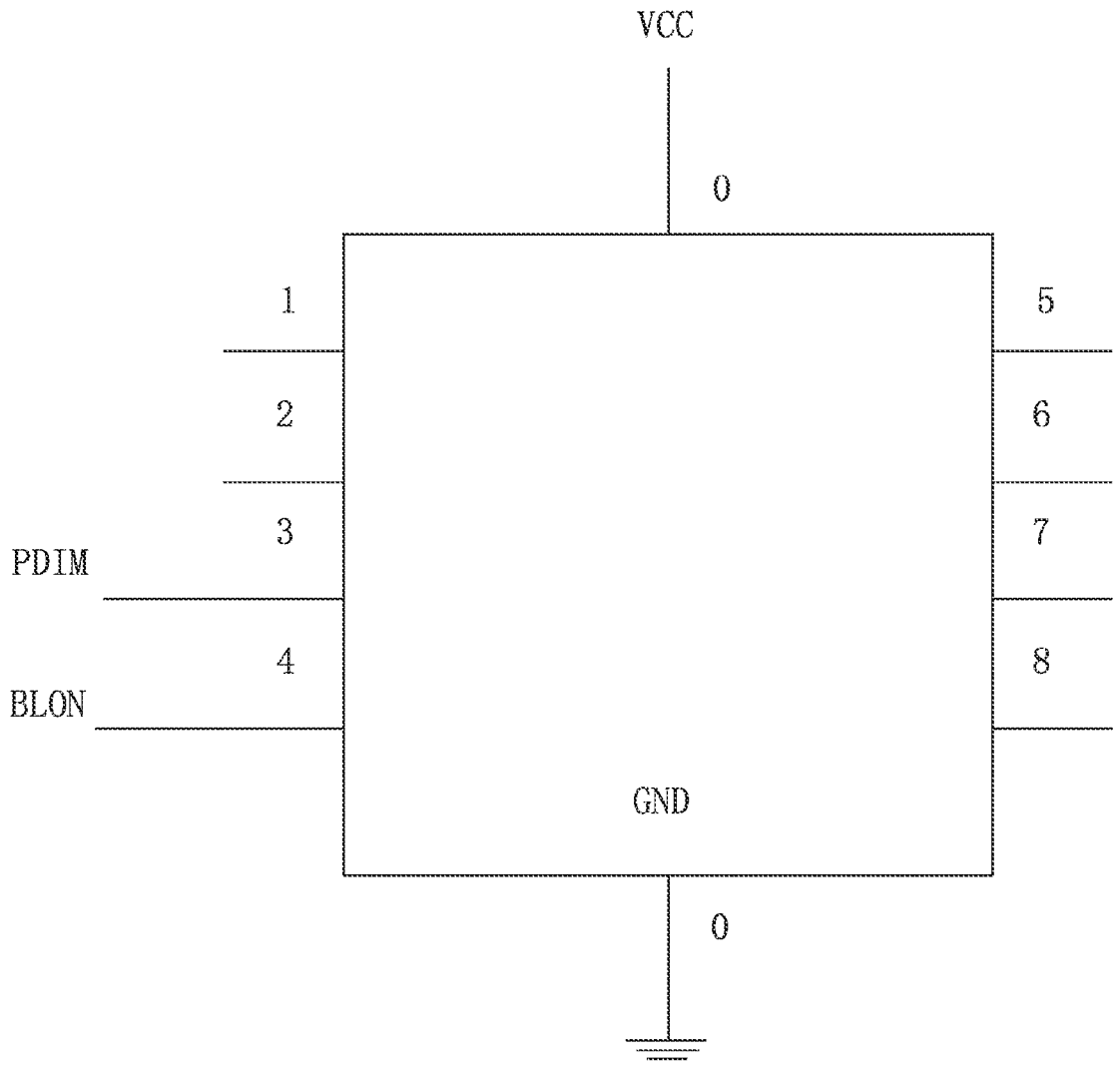
Fig. 1 (Prior Art)
FIG. 1 is a schematic view showing terminal arrangement of a conventional LED driving chip.
Figure 2:
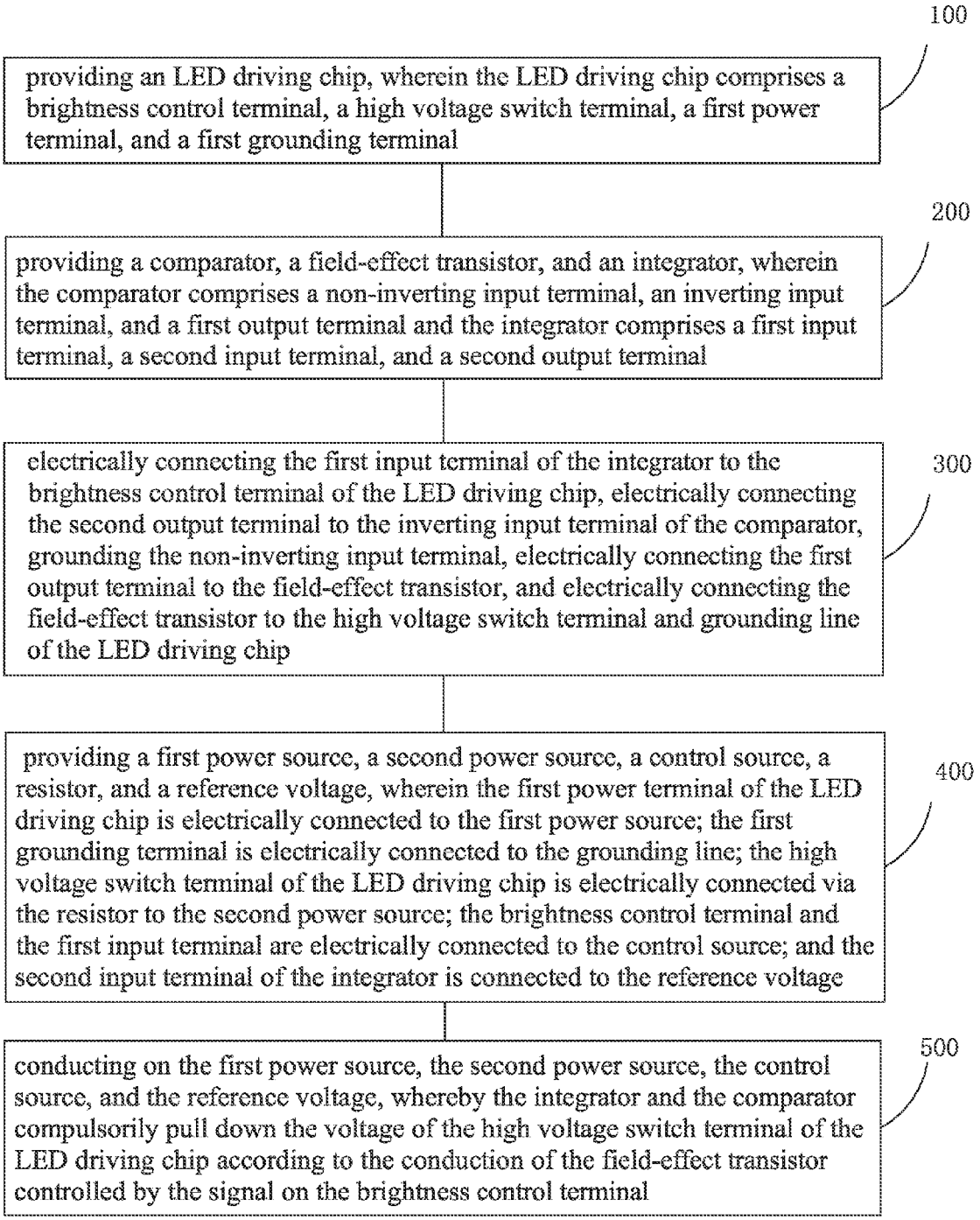
FIG. 2 is a flow chart illustrating a method for reducing standby power consumption according to the present invention.
Figure 3:
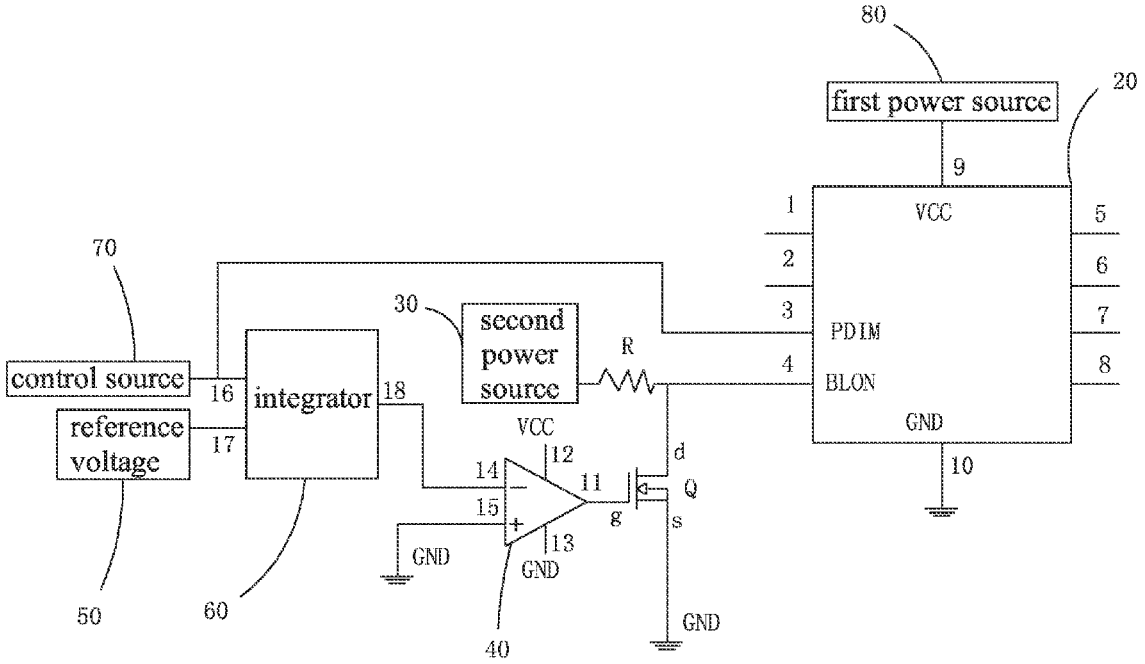
FIG. 3 is a schematic view showing a circuit for the method for reducing standby power consumption according to the present invention.

Referring to FIGS. 2 and 3, the present invention provides a method for reducing standby power consumption, which comprises the following steps:

Step 100: providing an LED driving chip, wherein the LED driving chip 20 comprises a brightness control terminal PDIM 3, a high voltage switch terminal BLON 4, a first power terminal VCC 9, and a first grounding terminal 10.

The LED driving chip 20 further comprises a plurality of output terminals 1, 2, 5, 6, 7, 8, . . . and the plurality of output terminals 1, 2, 5, 6, 7, 8, . . . are respectively connected to LED lights to drive the LED lights for emission of light. In the instant preferred embodiment, the number of the output terminals of the LED driving chip 20 is 6 but is not limited to 6.

The LED driving chip 20 controls the brightness of the LED light driven by the LED driving chip 20 according to the duty cycle of the signal of the brightness control terminal PDIM 3 in order to realize variability of the brightness of the LED light so as to meet various needs.

The high voltage switch terminal BLON 4 primary serves as an enable signal to control if the LED driving chip 20 is operating or cut off.

The first power terminal VCC 9 is connectable with an external power supply and provides power to the operation of the LED driving chip 20.

The LED driving chip 20 can be of a model number of TLC5941, MBI5028, and ST2221C.

Step 200: providing a comparator 40, a field-effect transistor Q, and an integrator 60, wherein the comparator 40 comprises a non-inverting input terminal 15, an inverting input terminal 14, and a first output terminal 11 and the integrator 60 comprises a first input terminal 16, a second input terminal 17, and a second output terminal 18.

The comparator 40 further comprises a second power terminal 12 and a second grounding terminal 13. The second power terminal 12 and the second grounding terminal 13 are externally connected to an operational power supply for the comparator. The operation voltage of the comparator 40 is in the range of 3-30V.

In the instant preferred embodiment, the field-effect transistor Q is preferably an N-channel field-effect transistor, which comprises a gate terminal g, a source terminal s, and a drain terminal d. Electrical voltage applied to the gate terminal g controls the conduction and cutoff of the field-effect transistor Q.

The field-effect transistor Q serves as an electronic switch circuit, which has a response speed higher than a regular switch and has various advantages such as high input impudence ($10^8$-$10_9\Omega$), low noise, low power consumption, large dynamic range, being easy to integrate, having no secondary breakdown, and wide safety operation range.

The integrator 60 carries out integration operation of input signals through the first and second input terminals 16, 17 to obtain an output signal and supplying the output signal to the second output terminal 18. The comparator 40 carried out an operation on two input voltages respectively received at the non-inverting input terminal 15 and the inverting input terminal 14 to output a voltage. The sign of being positive or negative of the output signal is primarily determined by the relationship between the two voltages received at the non-inverting input terminal 15 and the inverting input terminal 14. Specifically speaking, when the voltage of the non-inverting input terminal 15 is greater than that of the inverting input terminal 14, the comparator 40 outputs a voltage that is positive and on the other hand, when the voltage of the non-inverting input terminal 15 is smaller than that of the inverting input terminal 14, the comparator 40 outputs a voltage that is negative. In the instant preferred embodiment, the comparator 40 has a model number of LM324.

Step 300: electrically connecting the first input terminal 16 of the integrator 60 to the brightness control terminal PDIM 3 of the LED driving chip 20, electrically connecting the second output terminal 18 to the inverting input terminal 14 of the comparator 40, grounding the non-inverting input terminal 15, electrically connecting the first output terminal 11 to the field-effect transistor Q, and electrically connecting the field-effect transistor Q to the high voltage switch terminal BLON 4 and grounding line of the LED driving chip 20.

In Step 300, the gate terminal g is electrically connected to the first output terminal 11 and the source terminal s is connected to the grounding line. The drain terminal d is electrically connected to the high voltage switch terminal BLON 4 of the LED driving chip 20.

Step 400: providing a first power source 80, a second power source 30, a control source 70, a resistor R, and a reference voltage 50, wherein the first power terminal 9 of the LED driving chip 20 is electrically connected to the first power source 80; the first grounding terminal 10 is electrically connected to the grounding line; the high voltage switch terminal 4 of the LED driving chip 20 is electrically connected via the resistor R to the second power source 30; the brightness control terminal 3 and the first input terminal 16 are electrically connected to the control source 70; and the second input terminal 17 of the integrator 60 is connected to the reference voltage 50.

The level of the reference voltage 50 is determined according to a calculation made on maximum voltage, minimum voltage, and minimum duty cycle of a control signal supplied from the control source 70. When the control signal supplied from the control source 70 is of the minimum duty cycle, the level of the reference voltage 50 makes the output voltage of the integrator 60 exceeding 0V. This ensure that the field-effect transistor Q will not get conducted during a dimming process of the brightness control terminal PDIM 3 and the high voltage switch terminal BLON 4 may operate normally. The integrator 60 may supply a negative voltage according to the signal supplied from the control source 70 and the reference voltage 50.

Step 500: conducting the first power source 80, the second power source 30, the control source 70, and the reference voltage 50, whereby the integrator 60 and the comparator 40 compulsorily pull down the voltage of the high voltage switch terminal 4 of the LED driving chip 20 according to the conduction of the field-effect transistor Q controlled by the signal on the brightness control terminal PDIM 3.

The integrator 60 and the comparator 40 can compulsorily pulls down the voltage of the high voltage switch terminal 4 of the LED driving chip 20 according to the conduction of the field-effect transistor Q controlled by the signal on the brightness control terminal PDIM 3, namely the liquid crystal display device that uses the method is in a standby condition, thereby shutting off most of the functions of the LED driving chip 20 to achieve the purpose of reducing the standby power consumption.

Specific operation principle of the method for reducing standby power consumption according to the present invention will be described as follows:

When the brightness control terminal PDIM 3 of the LED driving chip 20 is in a condition of having a low duty cycle, the LED driving chip 20 is set in a standby condition. The low duty cycle and the reference voltage 50 applied to the integrator 60 are subjected to an integration operation in the integrator 60 so as to output a negative voltage to the inverting input terminal 14 of the comparator 40, while the non-inverting input terminal 15 of the comparator 40 is connected to the grounding line, whereby the voltage on the inverting input terminal 14 is lower than that of the non-inverting input terminal 15. Consequently, the first output terminal 11 of the comparator 40 supplies an output of high voltage level that conducts on the field-effect transistor Q. The conduction of the field-effect transistor Q compulsorily pulls down the electrical voltage on the high voltage switch terminal 4 of the LED driving chip 20, setting the high voltage switch terminal 4 under the control of low voltage level. This shuts off mot of the functions of the LED driving chip 20 to achieve the purpose of reducing standby power consumption.

In summary, the present invention provides a method for reducing standby power consumption, which comprise a comparator and an integrator to sample a signal on the brightness control terminal of IC of the LED driving chip so as to supply, at the time when a liquid crystal panel is in a standby condition, a control voltage to conduct a field-effect transistor connected to the high voltage switch terminal of the LED driving chip thereby compulsorily pulling down the voltage on the high voltage switch terminal to achieve the purpose of shutting off mot of the functions of the LED driving chip and thus effectively reducing the loss of the LED driving chip in the standby condition and reducing the standby power consumption. This method can be easily carried out.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A method for reducing standby power consumption, comprising the following steps:

(1) providing an LED driving chip, wherein the LED driving chip comprises a brightness control terminal, a high voltage switch terminal, a first power terminal, and a first grounding terminal;

(2) providing a comparator, a field-effect transistor, and an integrator, wherein the comparator comprises a non-inverting input terminal, an inverting input terminal, and a first output terminal and the integrator comprises a first input terminal, a second input terminal, and a second output terminal;

(3) electrically connecting the first input terminal of the integrator to the brightness control terminal of the LED driving chip, electrically connecting the second output terminal to the inverting input terminal of the comparator, grounding the non-inverting input terminal, electrically connecting the first output terminal to the field-effect transistor, and electrically connecting the field-effect transistor to the high voltage switch terminal and grounding line of the LED driving chip;

(4) providing a first power source, a second power source, a control source, a resistor, and a reference voltage, wherein the first power terminal of the LED driving chip is electrically connected to the first power source; the first grounding terminal is electrically connected to the grounding line; the high voltage switch terminal of the LED driving chip is electrically connected via the resistor to the second power source; the brightness control terminal and the first input terminal are electrically connected to the control source; and the second input terminal of the integrator is connected to the reference voltage; and (5) conducting on the first power source, the second power source, the control source, and the reference voltage, whereby the integrator and the comparator compulsorily pull down the voltage of the high voltage switch terminal of the LED driving chip according to the conduction of the field-effect transistor controlled by the signal on the brightness control terminal.

2. The method for reducing standby power consumption as claimed in claim 1, wherein level of the reference voltage is determined according to a calculation made on maximum voltage, minimum voltage, and minimum duty cycle of a control signal supplied from the control source.

3. The method for reducing standby power consumption as claimed in claim 2, wherein when the control signal supplied from the control source is of the minimum duty cycle, the level of the reference voltage makes the output voltage of the integrator exceeding 0V.

4. The method for reducing standby power consumption as claimed in claim 1, wherein the comparator further comprises a second power terminal and a second grounding terminal, the second power terminal and the second grounding terminal being externally connectable to an operational power supply for the comparator.

5. The method for reducing standby power consumption as claimed in claim 4, wherein the comparator has a model number of LM324.

6. The method for reducing standby power consumption as claimed in claim 1, wherein the field-effect transistor comprises a gate terminal, a source terminal, and a drain terminal and in Step (3), the gate terminal is electrically connected to the first output terminal; the source terminal is connected to a grounding line; and the drain terminal is electrically connected to the high voltage switch terminal of the LED driving chip.

7. The method for reducing standby power consumption as claimed in claim 6, wherein the field-effect transistor comprises an N-channel field-effect transistor.

8. The method for reducing standby power consumption as claimed in claim 1, wherein the LED driving chip further comprises a plurality of output terminals, which is respectively connected to LED lights.

9. The method for reducing standby power consumption as claimed in claim 8, wherein the output terminals of the LED driving chip have a number of 6.

10. The method for reducing standby power consumption as claimed in claim 8, wherein the LED driving chip is selectively of a model number of TLC5941, MBI5028, and ST2221C.

11. A method for reducing standby power consumption, comprising the following steps:

(1) providing an LED driving chip, wherein the LED driving chip comprises a brightness control terminal, a high voltage switch terminal, a first power terminal, and a first grounding terminal;

(2) providing a comparator, a field-effect transistor, and an integrator, wherein the comparator comprises a non-inverting input terminal, an inverting input terminal, and a first output terminal and the integrator comprises a first input terminal, a second input terminal, and a second output terminal;

(3) electrically connecting the first input terminal of the integrator to the brightness control terminal of the LED driving chip, electrically connecting the second output terminal to the inverting input terminal of the comparator, grounding the non-inverting input terminal, electrically connecting the first output terminal to the field-effect transistor, and electrically connecting the field-effect transistor to the high voltage switch terminal and grounding line of the LED driving chip;

(4) providing a first power source, a second power source, a control source, a resistor, and a reference voltage, wherein the first power terminal of the LED driving chip is electrically connected to the first power source; the first grounding terminal is electrically connected to the grounding line; the high voltage switch terminal of the LED driving chip is electrically connected via the resistor to the second power source; the brightness control terminal and the first input terminal are electrically connected to the control source; and the second input terminal of the integrator is connected to the reference voltage; and (5) conducting on the first power source, the second power source, the control source, and the reference voltage, whereby the integrator and the comparator compulsorily pull down the voltage of the high voltage switch terminal of the LED driving chip according to the conduction of the field-effect transistor controlled by the signal on the brightness control terminal;

wherein level of the reference voltage is determined according to a calculation made on maximum voltage, minimum voltage, and minimum duty cycle of a control signal supplied from the control source;

wherein when the control signal supplied from the control source is of the minimum duty cycle, the level of the reference voltage makes the output voltage of the integrator exceeding 0V;

wherein the comparator further comprises a second power terminal and a second grounding terminal, the second power terminal and the second grounding terminal being externally connectable to an operational power supply for the comparator;

wherein the comparator has a model number of LM324;

wherein the field-effect transistor comprises a gate terminal, a source terminal, and a drain terminal and in Step (3), the gate terminal is electrically connected to the first output terminal; the source terminal is connected to a grounding line; and the drain terminal is electrically connected to the high voltage switch terminal of the LED driving chip;

wherein the field-effect transistor comprises an N-channel field-effect transistor;

wherein the LED driving chip further comprises a plurality of output terminals, which is respectively connected to LED lights;

wherein the output terminals of the LED driving chip have a number of 6; and wherein the LED driving chip is selectively of a model number of TLC5941, MBI5028, and ST2221C.

* * * * *